US005313799A

United States Patent [19]

Siegel

[11] Patent Number: 5,313,799

[45] Date of Patent: May 24, 1994

[54] MAGNETIC ICE CUBE

[76] Inventor: Israel Siegel, 2980 Point East Dr., #D-612, N. Miami Beach, Fla. 33160

[21] Appl. No.: 972,953

[22] Filed: Nov. 6, 1992

[51] Int. Cl.[5] ..... F25D 5/00

[52] U.S. Cl. ..... 62/4; 126/263 R

[58] Field of Search ..... 62/3.1, 4, 94; 126/263

[56] References Cited

U.S. PATENT DOCUMENTS 1,863,579 6/1932 Morse et al. ..... 62/93

5,168,708 12/1992 Siegel ..... 62/4

*Primary Examiner*—Ronald C. Capossela

[57] ABSTRACT

The magnetic ice cube works without a freezer or a refrigerator, and can be stored for indefinite periods at room temperature without losing its cooling potential. The cooling element of the magnetic ice cube consists of an air evacuated sealed heat exchange chamber containing water. The water will boil at low temperature and absorb heat from its environment, if the vapor generated by the boiling water is removed. This is accomplished by a desiccant placed in a separate chamber. The vapor passes through a tube, into the chamber containing the desiccant which removes the vapor. The top portion of the tube is placed in the desiccant chamber, is flexible, and communicates with its environment through a hole in a rubber lined inside magnet. During storage of the device, a force of attraction between the inside magnet and an outside surface magnet causes the inside magnet to press against a rubber layer lining the top inside surface of the desiccant chamber. This blocks the hole in the magnet and closes the communication between the chambers. The cooling process is initiated by turning the outside magnet upside-down. This changes the attractive force between the magnets to a repulsive force. This pushes the inside magnet away from the surface rubber layer and opens the communication between the chambers. Surface extensions from the walls of the desiccant chambers limit the travel of the inside magnet away from the outside magnet.

10 Claims, 1 Drawing Sheet

MAGNETIC ICE CUBE

BACKGROUND AND OBJECTIVES

The invention relates to self cooling and self heating containers, and in particular to self-heating and self heating sorption containers which operate without valves which perforate the surfaces of the device. Previous inventions relating to sorption self cooling and self heating containers have been described by the present author in U.S. Pat. Nos. 4,250,720, 4,736,599, 4,928,495, 5,079,932 and 5,168,708. Essentially, the self cooling and self heating containers consists of a chamber containing water, the boiling point of which has been lowered by an air vacuum in the chamber. The chamber communicates through a pipe with another chamber containing a desiccant. As the water boils it cools itself and absorbs heat from a food or a beverage which is preferred to be consumed at low temperatures. The vapor generated by the low boiling point water is removed by the desiccant. The vapor sorbed by the desiccant heats the desiccant. The desiccant then delivers heat to a food or a beverage which is preferred to be consumed at high temperatures. By closing the communication between the water and desiccant chambers the self cooling and self heating device can be stored indefinitely without losing its temperature changing potential. The cooling or heating action is initiated by opening of the communication between the water and the desiccant chambers. Thus, a reversible closing of the communication between the water and the desiccant chamber is essential for the storage and operation of the device. This has been previously achieved by valve means which open and close the pipe between the chambers.

The air vacuum which is required to lower the boiling point of the water, must often be maintained through out months or even years of the shelf life of the food or beverage. To prevent an air leak into the system through the valve an air tight and leak proof valve is essential. Standard valves which are manipulated through means which have perforated the wall of the temperature changer present a continuous leak hazard and are not suited for such strict and long term vacuum requirements. Commercially available vacuum valves are too expensive for use in commonly used beverage containers. In U.S. Pat. No. 5,168,708 I have described a pliable outside surface, such as a bellows, as means to open and close the communication between the water and desiccant chambers without perforating the surfaces of the chambers. In recent U.S. patent applications I have described magnetic means to open and close the communication between the chambers while maintaining the integrity of the chambers surfaces. The magnetic force between two bodies varies inversely as the square of distance between the bodies. The magnetic force is therefore largely decreased with even relatively small distances between a magnet and a magnet responsive object. In recent U.S. patent applications I have described magnet responsive stoppers present inside an air evacuated containers responding to a magnet on the outside surface of the container. A disadvantage of magnetic stopper mechanism is the fact that the stopper must travel a relatively long distance towards and away from the outside magnet in order to close and open the communication between the chambers. The main objective of the present invention is to provide a self cooling container with a closing and opening mechanism which would minimize the distance of travel between the magnet and its magnet responsive object.

An additional disadvantage of a stopper mechanism is the fact the stopper must be fitted tightly into its opening to provide a leak proof seal. This requires a relatively large force not only to push the stopper into its opening but also to pull the stopper from its opening. This force often exceeds the magnetic forces provided by small low cost magnets. Another objective is to provide a magnet responsive closing and opening mechanism which require relatively little force to effectively open and close.

SUMMARY

The magnetic ice cube is based on the physical law that the boiling point of water can be lowered to ice temperature by an air vacuum. The cooling element of the magnetic ice cube consists of a sealed chamber from which the air has been removed. The chamber contains water. The air vacuum causes the water to boil spontaneously until it cools itself and its surroundings to its low boiling point temperature, provided that the vapor, generated by the low boiling point water, is removed from the sealed chamber. This is accomplished by a desiccant that is placed in a separate top chamber. The vapor generated by the low boiling point water must pass through a tube, which communicates between the water chamber and the desiccant chamber. The top of the tube is flexible and communicates with its environment through a hole in a rubber lined magnet inside the desiccant chamber.

A force of attraction between an outside magnet and the inside magnet causes the inside magnet to press against a rubber layer lining the top inside surface of the desiccant chamber. This blocks the hole in the magnet, and prevents a communication between the water and the desiccant chamber. The magnetic ice cube can then be stored at ambient temperature forever without losing its cooling potential. The cooling process is initiated by turning the outside magnet upside down. This changes the attractive force between the magnets to a repulsive force. This pushes the inside magnet away from the surface rubber layer and allows vapor to enter the desiccant chamber. This starts a vigorous boiling of the water, and cools the water chamber and its immersing beverage in several minutes. Surface extensions from the walls of the desiccant chambers limit the distance of travel of the inside magnet away from the outside magnet.

The magnetic ice cube can be re-charged by expelling the water vapor from the desiccant, back into the water chamber. This is accomplished by heating the desiccant chamber to about 250 degrees Centigrade for about 2 hours. The heat is provided by electric coils on the outside surfaces of the desiccant chamber. The coils are activated by a 2 hour connection to any household electric power.

FIG. 1 is a cross section of the magnetic ice cube.

DETAILED DESCRIPTION

Figure 1:
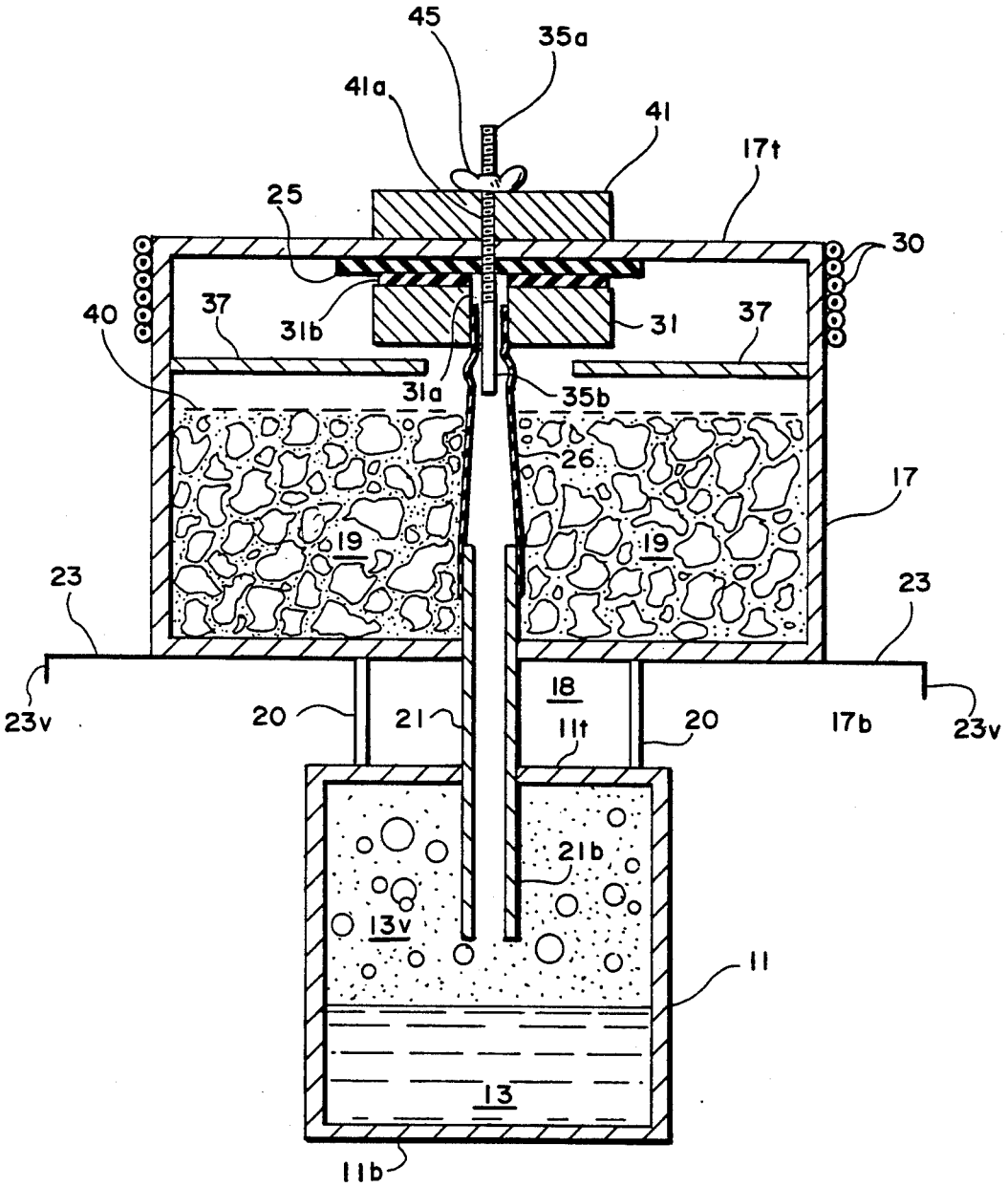

Referring to FIG. 1, there is shown a chamber 11, with top wall 11-*t* and bottom wall 11-*b*. An air vacuum is present in the chamber. The walls of the chamber and all other structural components which are exposed to atmospheric air are constructed of non-porous materials, such as tin, aluminum, or plastic. The material must be strong enough so that it does not deform during the presence of an air vacuum in the chamber. Water 13 is present in the chamber. The air vacuum required may be achieved through a temporary outlet (not shown) connected to an air pump (not shown). The same outlet may then be connected to a water source (while maintaining the air vacuum), to transfer water 13 into the liquid chamber 11. The outlet is sealed after the transfer of the water into the chamber. The water evaporates to form a vapor phase 13*v* above the liquid level of the water 13.

Present above chamber 11 is another chamber 17, with top wall 17*t* and bottom wall 17*b*. A space 18 is present between the chambers. The air space serves as an insulating layer between the chambers. Rods 20 are present between the chambers in space 18. The top of rods 20 are attached to the bottom wall of chamber 17, while the bottom of rods 20 are attached to top wall 11*t* of chamber 11. This fixes the relative positions of chamber 11 and chamber 17. Present on the inside top surface of chamber 17 is a rubber layer 25. The layer functions as a rubber washer and cover, as will be described. Inside the chamber 17 there is a desiccant 19, such as calcium sulfate, or a non-toxic molecular sieve like Silico Aluminate Zeolite. Present on the outside surfaces of chamber 17 are electric heating coils 30. Associated with the coils is a thermostat (not shown) to keep the coils at a predetermined temperature. The coils function as the desiccant regenerating means, as will be described. Extending from the bottom surface 17*b* of container 17 are horizontal wall extensions 23. The extensions are designed to rest on the margins of containers in order to support chamber 17 when chamber 11 is inserted into a beverage in the container, as will be described. Present at the ends of extensions 23 are vertical rods 23*v*.

Communicating between chambers 11 and 17 is a vertical pipe 21. The bottom of pipe 21 penetrates the bottom wall 11-*b* into container 11 and extends to about the center of container 11. The top of pipe 21 penetrates the bottom wall of container 17 into the upper portion of chamber 17 to a height of at least an inch in chamber 11. The pipe 21 thus consists of a pipe portion present between chambers 11 and 17, a pipe portion 21*a* present in chamber 17, and a pipe portion 21*b* present in chamber 11. Solder is applied to the junctions of the chambers surfaces which have been penetrated by the pipe. This fixes the pipe in place, and prevents any leakage from the junctions. The arrangement is that the relative volumes of water 13 and container 11, and the relative dimensions of container 11, are such that the level of water 13 never reaches the bottom opening of pipe 21*b*, even when the container 11 is placed on its side or in an upside down positions. This functions to hinder the accidental transfer of water 13 from water chamber 11 to chamber 17 when the communication between chambers 11 and 17 is opened, as will be described.

Present on top of chamber 17 is a guiding rod portion 35*a*. The rod penetrates the center of wall 17-*t* and continues into the top inside portion of chamber 17 as a guiding rod portion 35*b*. The penetrated area of surface 17*t* is sealed with solder, to maintain the structural integrity of surface 17-*t* and prevents any leak from the chamber 17. Present in the top portion of chamber 11 is a magnet 31. The magnet is in the shape of a flat disk. Present in the center of magnet 31 is a hole 31-*a*. Attached to the magnet's top surface is a rubber layer 31*b*. The rubber layer functions as a rubber washer, as will be described. The shape and size of layer 31*b* corresponds to the shape and size of magnet 31 with a corresponding hole in the middle of the layer. The arrangement is, that like a ring, magnet 31 is slipped over rod 35*b*, so that rod is present in hole 31*a*. This allows a free vertical movement of the magnet but limits the side movements of the magnet. Attached to the inside side walls of chamber 17 are horizontal rods 37. The arrangement is that rods 37 are at a level which is slightly below the horizontal level of magnet 31 when magnet 31 presses against the inside surface of top wall 17*a*. The rods extend inward towards the center of chamber 17 to a distance which exceeds the borders of magnet 31. The arrangement is that as magnet 31 travels downward it encounters rods 37. The rods, thus, limit the downward movement of magnet 31.

Present on the surface 17-*t* is an outside magnet 41. The shape of outside magnet 41 is similar to that of inside magnet 31. Present in middle of magnet 41 is a hole 41*a*. The arrangement is, that like a ring, magnet 41 is slipped over rod 35*a*, so that rod is present the hole 41*a*. This allows a free vertical movement of the magnet but limits the side movements of the magnet. This keeps magnet 41 in a position which is opposite that of magnet 31. The guiding rod 35*a* is threaded in order to hold wing nut 45 above magnet 41. This prevents the magnet 41 from falling off the guiding rod.

Fitted over the open end of tube portion 21*a* of tube 21 is a flexible rubber or plastic tube 26. The relative dimensions of tubes 21 and 26 are such that the bottom of tube 26 fits tightly over the tube portion 21*a* to prevent any leak from the junctions of the tubes. The top of tube 26 is inserted in hole 31*a* to about half the height of the hole. The outside surfaces of the top of tube 26 are glued tightly to the inside surfaces of the bottom half of hole 31*a* so that any vapor entering tube 26 must enter through the upper half of hole 31*a*. The length of tube 26 is such, that its top can travel with magnet 31 when the magnet reaches the inside of top surface 11*t*. The relative strength of the magnets are such that when magnet 41 is placed on guiding rod 35*a* with its bottom surface having a polarity opposite to that of the polarity of the top surface of magnet 31, the force of attraction between the magnets overcomes the force of gravity and causes magnet 31 to travel upward towards magnet 41.

Present on the top surfaces of desiccant 19 is a net 40. The borders of the net are attached to the inside walls of container 17 to fix the net in a plane which is lower than the horizontal level of rods 37. The arrangement is that the openings of net 40 are smaller then the individual granules of desiccant 19. The net thus forms a physical barrier which prevents the desiccant granules from entering tube 26. The net thus prevents the accidental transfer of desiccant 19 from desiccant chamber 17 to water chamber 11, but allows a free movement of vapor between the chambers.

The operation of the device is as follows. When a cooling action is not desired magnet 41 is present on the outside surface of top wall, on guiding rod 35*a*, with the magnet's bottom surface having a polarity opposite to that of the polarity of the top surface of magnet 31. Wing nut 45 fixes the position of magnet 41 and prevents an accidental movement of magnet 41 from its position. The force of attraction between the magnets causes magnet 31 to travel upward towards magnet 41, until magnet 31 reaches the inside top surface of top wall 11*t*. The force of attraction between the magnets causes magnet 31 to press against the inside surface of wall 11*t*. When this occurs rubber layer 31*b*, on the surface of magnet 31, presses against rubber layer 25 lining the inside top surface of 17*t*, and layer 25 covers hole 31*a* of magnet 31. This block entrance of vapor into opening 31*a* and tube 26. This closes the communication between chambers 11 and 17. The vacuum in chamber 11 causes water 13 to boil until the vapor pressure in chamber 11 becomes equal to the vapor pressure of the boiling water. This stops the additional boiling of the water, and the device can be stored indefinitely at ambient temperatures without losing its cooling potential.

When a temperature change is desired wing nut 45 and magnet 41 are removed from guide rod 35*a*. Magnet 41 is then turned upside-down and placed on guiding rod 35*a* with the bottom surface of magnet 41 having a polarity which is the same as that of the top surface of magnet 31. Magnet 41 is then placed on the outside surface 17*t* of container 17 and wing nut 45 is placed above the magnet to keep the magnet in its position. Magnet 31 is then repelled from magnet 41. The force of repulsion causes magnet 31 to travel downward towards rods 37. This causes a separation between rubber layers 25 and 31*b*. This opens hole 31*a* and allows a communication between chambers 11 and 17.

The vapor generated by the boiling of water 13 leaves chamber 11 and enters chamber 17 through tube 26. The vapor which has entered chamber 17 is absorbed or adsorbed by desiccant 19. The vapor sorbed by the desiccant deposits its heat content in the desiccant. This heats the desiccant. The heat is then lost to the outside environment through the walls of the desiccant chamber. If desired, the heat may be transferred to a food or beverage (not shown) placed in contact with desiccant chamber walls. The sorption of the vapor in the desiccant chamber reduces the vapor pressure in chamber 17 to below that of chamber 11. This causes an additional transfer of vapor from chamber 11 to chamber 17. The vapor in chamber 11 is then replaced by additional boiling of water 13 in chamber 11. The water boils continuously until desiccant 19 is saturated with water vapor, or until the temperature of water 13 drops to its low boiling point. When the temperature of water 13 drops it cools chamber 11. The relatively cold surfaces of container 11 is then dipped in a beverage to absorb heat from the immersing beverage.

If the device is accidentally tilted during the cooling process the force of gravity will cause water 13 to accumulate in the sides, corners, or back of the container 11, away from the bottom open end of tube 21*b*. This will hinder water 13 from entering container 17 and aborting the cooling process.

The temperature changing capabilities of the system can be renewed by a selective heating of the desiccant chamber through coils 30. This can be accomplished as follows. Magnet 41 is placed on surface 17*t* in a way that would repel magnet 31, as described above. This would keep the communication between chambers 11 and 17 open. Container 11 is them immersed in ambient temperature water to keep chamber 11 relatively cold. Desiccant chamber 17 is then connected to household electric power for about 2 hours. During this period the coils 30 (controlled by a thermostat) heat desiccant 19 to about 250 degrees C. This expels the vapor sorbed by desiccant 19 back into water chamber 11. The vapor re-condenses into water in chamber 11, because of the relatively low temperature in chamber 11. After about 2 hours magnet wing nut 45 and magnet 41 are removed. Magnet 41 is then turned upside-down and returned to guiding rod 35. The force of attraction between magnets 31 and 41 causes the magnets to close the communication between the chambers as described above. The desiccant chamber is then disconnected from the electric current, and chamber 11 removed from the immersing water. The device can then be stored indefinitely at ambient temperatures without losing its temperature changing potential. It can be reactivated by turning magnet 41 upside-down as described above.

It is understood that the above preferred embodiment was given as an example, and that a variety of changes may be made without departing from the essence of the invention, as defined in the claims. For example, a variety of structural means may be used to reduce the distance between the outside magnet and the inside magnet responsive body. While the present invention used a magnetic force of attraction to close the communication and a magnetic force repulsion to open the communication the role of the magnetic forces may be reversed. Chambers 11 and 17 may be made in a variety of shapes for cosmetic or practical reasons. For example, the part of the top surface of the desiccant chamber may be concave in order to receive a food, such as soup. Thus, the magnetic ice cube may simultaneously serve as a cooling bottom insert and a warming top plate. While the invention described a top desiccant chamber and a bottom water chamber, the positions of the chambers can be reversed. And the desiccant chamber can then function as a self heating cube. A variety of magnetic arrangements may be used to close and open the communication between the chambers. For example, a disc made out of a magnet responsive material, such as iron instead of a magnet, may be substituted for one of the magnets. Instead of turning the outside magnet upside-down the magnet or the magnet responsive body may be removed from the outside surface. The inside magnet or magnet responsive body may then travel away from the surface through a force of gravity or a spring force. Refrigerants other than water, such as an alcohol, or a freon, may be used as cooling low boiling point cooling agents.

What is claimed is:

1. A sorption temperature changer consisting of a heat exchange chamber, a liquid in said chamber, an air vacuum in said liquid chamber to lower the boiling point of said liquid, a second chamber, a desiccant in said second chamber, a communication between said liquid and said desiccant chambers, a magnetic mechanism to open and close said communication between the chambers, said magnetic mechanism includes at least one magnet and one magnet responsive body, said components of said magnetic mechanism adapted to travel towards and away from each other to close and open said communication, and means to minimize the distance of said travel required for changing the opening and closing states of said communication.

2. The invention as described in claim 1 and including means to limit the travel of said components away from each other during the operation of said magnetic mechanism.

3. The invention as described in claim 1 wherein said heat exchange chamber is adapted to be immersed in a beverage to change the temperature of said beverage.

4. The invention as described in claim 1 wherein said liquid is water.

5. The invention as described in claim 1 and including means to regenerate said desiccant.

6. The invention as described in claim 1 wherein said magnet responsive body is a magnet.

7. A sorption temperature changer consisting of a heat exchange chamber, a liquid in said chamber, an air vacuum in said liquid chamber to lower the boiling point of said liquid, a second chamber, a desiccant in said second chamber, a communication between said liquid and said desiccant chambers, wherein top of said communication is flexible, is present in one of said chambers, and communicates with its environment through a hole in an inside magnet, an outside magnet placed opposite said inside magnet wherein a chamber wall is present between the inside and outside magnets, said inside magnet adapted to move towards said outside magnet and to press against the inside of said wall during the presence of an attractive force between said magnets, said wall covering the hole of said magnet to prevent a communication between said chambers, means to reverse the polarity of one of said magnet to change the attractive force between the magnets to a repulsive force to cause said magnets to separate from each other, and to open said communication between the chambers.

8. The invention as described in claim 7, wherein said inside magnet is lined with a washer.

9. The invention as described in claim 7, wherein at least a portion of the inside of said separating wall is lined with a washer.

10. The invention as described in claim 7, wherein said means to reverse the polarity consists of turning the outside magnet upside-down.

* * * * *